United States Patent [19]

Rush et al.

[11] Patent Number: 5,006,847

[45] Date of Patent: Apr. 9, 1991

[54] TRAIN MOTION DETECTION APPARATUS

[75] Inventors: Donald L. Rush, Penn Hills Township, Allegheny County; Norman W. May, Pittsburgh, both of Pa.

[73] Assignee: AEG Westinghouse Transportation Systems, Inc., Pittsburgh, Pa.

[21] Appl. No.: 180,702

[22] Filed: Apr. 5, 1988

Related U.S. Application Data

[63] Continuation of Ser. No. 672,039, Nov. 16, 1984, abandoned.

[51] Int. Cl.[5] ..... G08G 1/12; G08G 1/07

[52] U.S. Cl. ..... 340/994; 246/3; 246/122 R; 364/437

[58] Field of Search ..... 246/122 R, 123, 182 R, 246/3, 4, 187 B; 364/436, 438, 437; 340/994

[56] References Cited

U.S. PATENT DOCUMENTS

| | | | |
|---|---|---|---|
| 2,009,950 | 7/1935 | Wells | 246/123 |
| 2,712,595 | 7/1955 | Cadman | 246/123 |
| 3,109,616 | 11/1963 | Hailes | 246/123 |
| 3,176,125 | 3/1965 | Smith | 246/123 |
| 3,248,521 | 4/1966 | Freeman | 246/2 S |
| 3,402,289 | 9/1968 | Burke et al. | 246/167 R |
| 3,575,594 | 4/1971 | Elcan | 246/2 R |
| 3,601,602 | 8/1971 | Smith | 246/122 R |
| 3,771,119 | 11/1973 | Evans | 246/122 R |
| 3,771,463 | 11/1973 | Smoot et al. | 246/108 |
| 3,805,056 | 5/1972 | Birkin | 246/187 B |
| 4,179,739 | 12/1979 | Virnot | 246/3 |
| 4,220,946 | 9/1980 | Henriot | 340/994 |
| 4,361,300 | 11/1982 | Rush | 364/436 |
| 4,361,301 | 11/1982 | Rush | 364/436 |
| 4,495,578 | 1/1985 | Sibley et al. | 246/167 R |
| 4,562,543 | 12/1985 | Zuber et al. | 246/182 R |

FOREIGN PATENT DOCUMENTS

| | | | |
|---|---|---|---|
| 0017797 | 2/1977 | Japan | 340/994 |
| 0066175 | 6/1977 | Japan | 340/994 |

*Primary Examiner*—Alvin E. Oberley

*Attorney, Agent, or Firm*—Spencer & Frank

[57] ABSTRACT

An apparatus and method is provided for determining when a train operating in a transit system is not moving along a provided travel path in accordance with the sensed actual occupancy time of a track signal block by that train in relation to a desired occupancy time in that track signal block by that train.

3 Claims, 8 Drawing Sheets

TRAIN MOTION DETECTION APPARATUS

This application is a continuation of application Ser. No. 06/672,039 filed Nov. 16, 1984, now abandoned.

CROSS-REFERENCE TO RELATED PATENTS

The present invention is related to the inventions disclosed in U.S. Pat. Nos. 4,361,300 and 4,361,301 by D. L. Rush and respectively entitled Vehicle Train Routing Apparatus and Method and Vehicle Train Tracking Apparatus and Method, which are assigned to the same assignee and the disclosures of which are incorporated herein by reference.

BACKGROUND OF THE INVENTION

1. Field of the Invention

The invention relates in general to determining when a transit vehicle that is automatically controlled to move along a roadway track including a plurality of station areas is actually moving as desired.

2. Description of the Prior Art

It is known in the prior art to provide an identification system in relation to a transit vehicle train to enable the routing of that train moving along a roadway track by determining the desired movement route of the train in accordance with known available routes from one station in relation to another station and the known track plan, the desired direction of movement and cleared gates in relation to switches. It is known to enable the tracking of that train by detecting when each track circuit signal block becomes occupied and when it becomes unoccupied for establishing a position memory in relation to the successive track circuit blocks.

SUMMARY OF THE INVENTION

The present invention relates to determining when a transit vehicle is not operating in accordance with desired motion or is stopped along a predetermined travel route of a manned or unmanned passenger vehicle system, which can include vehicles that are inaccessible on an elevated roadway track. A central station control operator is alerted in relation to stopped or late vehicles to prevent successive vehicle trains being stopped in consecutive stations and waiting on a stalled train at the head of a stack of such trains in an automatically controlled train system.

DESCRIPTION OF A PREFERRED EMBODIMENT

The function of the no motion alarm control apparatus and method is to establish when there has been no train movement in a selected area for a predetermined filter period of time. It determines when trains are stalled, stopped or moving at speeds much lower than requested. It detects when trains are stacking up behind other trains, either on a station basis or on a track circuit basis.

This system is provided to alert the Central Control operator that one or more of the manned or unmanned vehicles on the system is not operating at the proper speed or is stopped.

On such a system it is typical for penalties to be allotted to all stoppages of more than one minute. In addition, each train that does not complete a loop in the proper amount of time should be printed out as a late train. These operating constraints make it very important that the operator knows when and where a train has stopped so that some corrective action can be taken.

The first part of the system monitors lack of motion on a loop, sub-loop, shuttle leg or any other configuration involving a route. When a route is established for a train, all track circuits within a given route are monitored for change of occupancy state. Clocks are used to determine how long it has been since a train movement has been detected in relation to each track circuit, and each route has some maximum time that should not be exceeded. If no train moves for the established period of time, the operator is alerted by the train late alarm and the alarm condition is logged.

The second part of the system determines when trains are stacking up on the track system. Although there may still be at least one train in desired motion on the system, another train is stopped somewhere. This detection is done in relation to each track circuit or blocks of track circuits and the station logic. This monitoring and alarming will use sets of track circuit related tables to determine when trains, which are stopped at stations, are waiting on trains stopped in the next station that have already been alarmed or not. A table, with the same length as the number of track circuits in the track system will be constructed for: train numbers, car numbers, time to traverse, error already detected, type and so forth. The table of run times will be modified based on desired dwell times, switch operations, and so forth. This no motion alarm system will enable the operator to realize when there is a problem before all trains are stopped in consecutive stations waiting on the stalled train at the head of the stack. This system should substantially reduce the number of chargeable downtimes on any automatic train system.

Figure 1:
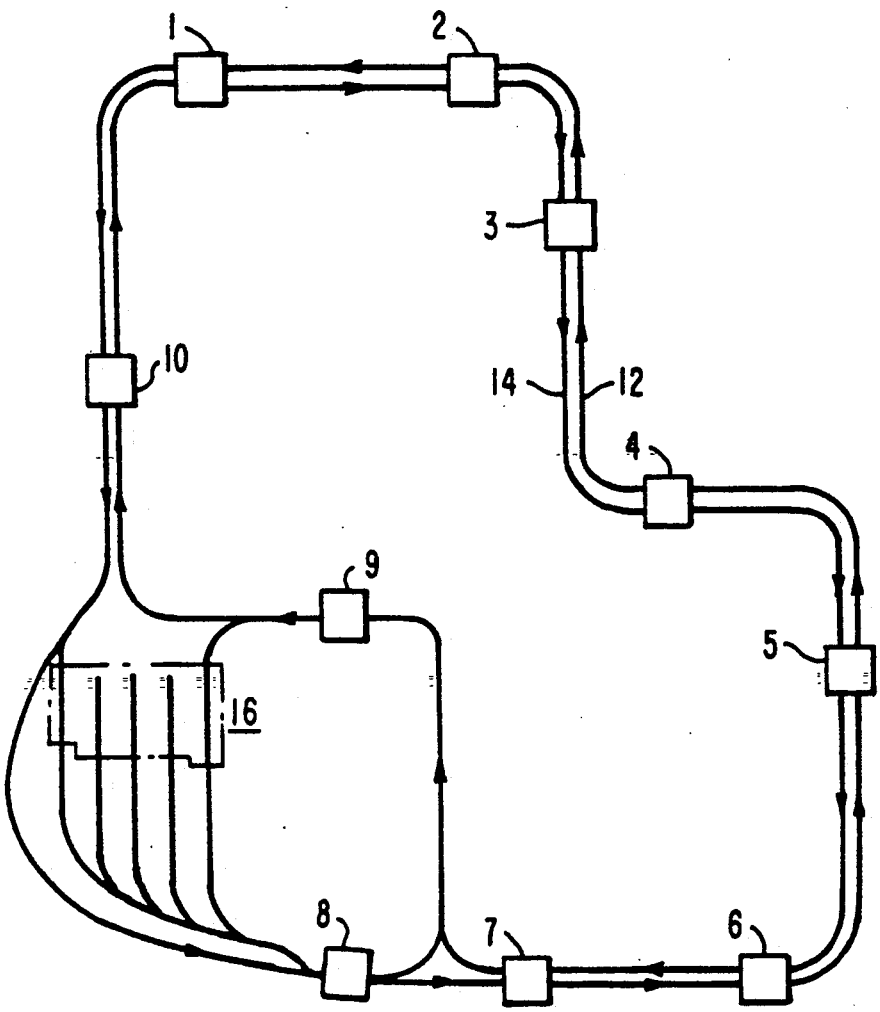
PRIOR ART FIG. 1
FIG. 1 shows a prior art arrangement of a typical track system.

In FIG. 1 there is shown an illustrative prior art physical arrangement diagram of a typical passenger vehicle roadway track, such as for the Miami, Florida, downtown passenger transit system, including the indicated passenger stations 1 through 10, and having an outer track 12 for vehicle movement in one direction and an inner track 14 for vehicle movement in the opposite direction. A vehicle maintenance area 16 is provided. Track signal blocks are provided along each of the roadway tracks. The arrows indicate direction of travel and the squares indicate passenger stations.

Figure 2:
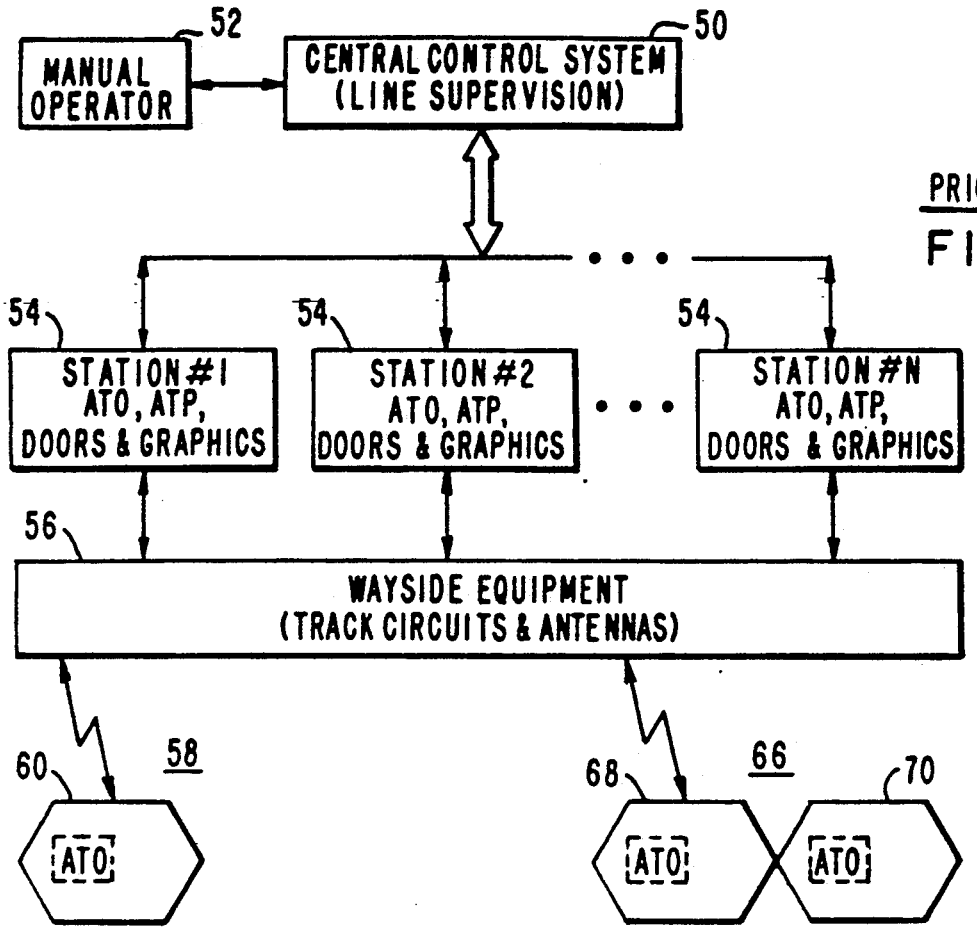
PRIOR ART FIG. 2
FIG. 2 shows a schematic block diagram of a prior art vehicle train control apparatus.

In FIG. 2, there is shown a prior art central control system 50, which can be located in a headquarters building and receives information about the transit system and individual vehicle train operation. A system manual operator 52 establishes the desired performance of the individual vehicle trains. The central control system 50 supervises the schedule, spacing and routing of the individual trains. The passenger loading and unloading stations 54 are provided to operate with the central control system 50 as desired for the particular transit system. The wayside equipment 56 including track signal block circuits and associated antennas for speed commands, door control and program stop control signals is located along the vehicle track roadway between the stations and is provided to convey information in relation to passenger vehicle trains travelling along the roadway track. A first illustrative train 58 is shown including vehicle car 60 and a second train 66 is shown including two vehicle cars 68 and 70. Each vehicle car includes an automatic train operation ATO and automatic train protection ATP apparatus to make up the automatic train control ATC apparatus carried by each vehicle car. The automatic train control ATC apparatus includes the program stop receiver module, the speed code receiver module, the vital interlock board and power supplies and all the modules required to interface with the other equipment carried by the train vehicle, and in accordance with the more detailed description set forth in the above-referenced patents.

Figure 3:
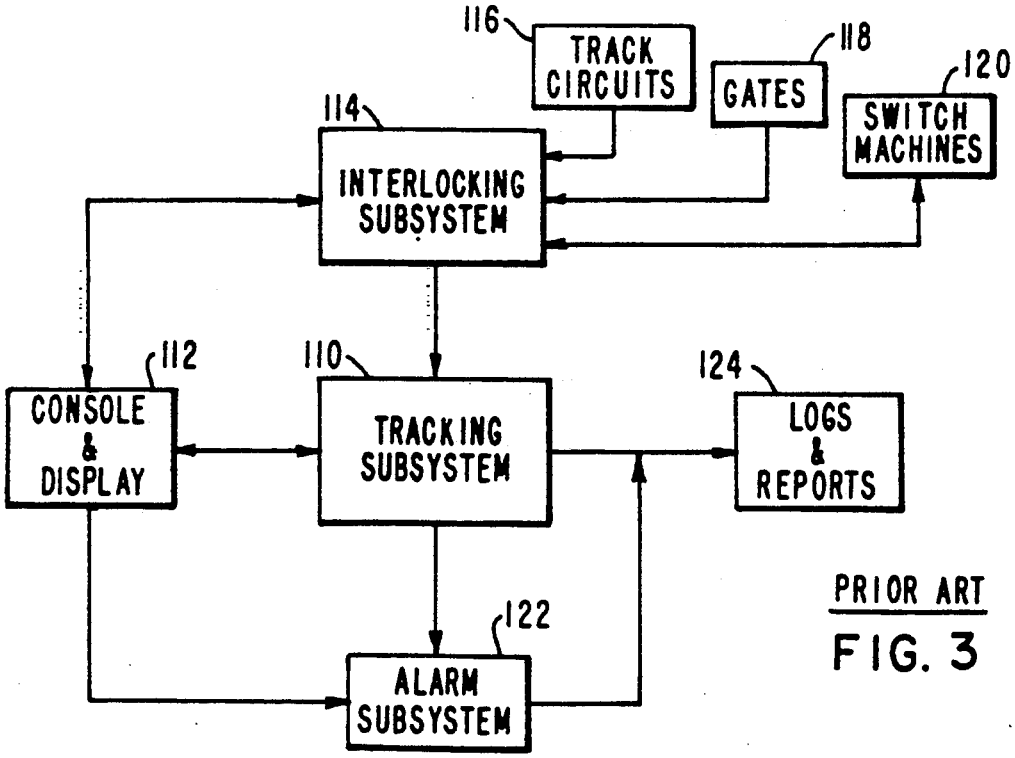
PRIOR ART FIG. 3
FIG. 3 shows the signal flow of a prior art train control system.

FIG. 3 shows a prior art train tracking signal flow. The center block 110 shows the tracking subsystem, which includes the programmed digital computer, the inputs and outputs to the computer and the several program routines and subroutines disclosed in above U.S. Pat. No. 4,361,301. At the left side is the console and display 112. Information that goes from the console 112 to the tracking program within the tracking subsystem 110 are such things as each train number and the car numbers within each train to set up the system so the tracking subsystem can follow each of the trains around the track and keep track of them for the purpose of logging. Once the train is put on the track system shown in FIG. 1 this tracking subsystem keeps track of which train it was and what cars are in the train. On the display portion of the console 112, there are facilities to display the train number and car number for any train on the system by requesting this information with the proper pushbuttons and switches on the operator's console. The interlocking subsystem 114 checks to see if it is safe to allow the train to make a move, and provides for the vehicle safety of the system. The information required for the interlocking subsystem 114 includes the track circuit information, the gate status and the switch positions and is operative with the track circuits 116, the gates 118 and the switch machines 120.

The tracking subsystem 110 gets information from the interlocking subsystem 114 to allow the tracking subsystem 110 to follow each train around the track system. A primary input is from each track circuit in regard to when the track circuit becomes occupied or becomes unoccupied, which are two signals that the tracking subsystem 110 uses to follow a train. It also has to have the switch position indications to know which path a train is going to take when it comes into a switch block. The interlocking subsystem 114 does not supply the direction input when needed, since the direction indication from interlocking 114 disappears at the time the track circuit becomes occupied, which is too early for the tracking subsystem 110 to use this direction information. Therefore, a direction table is constructed using the various track circuit direction indications and a program routine determines what direction the train is going in relation to every single track circuit block.

The information from the tracking subsystem 110 is used to provide an alarm to the alarm subsystem 122, if a train appears where it is not supposed to be, such as when a false occupancy of a track circuit shows up or if a train drops out of a track circuit and the operator needs to know this has happened. The tracking subsystem 110 provides a message when a false occupancy or a dropout occurs, which is logged in the computer and is printed out on a line printer in the logs and reports 124. The tracking subsystem 110 keeps track of every car, and every train on this track system from the time it enters until it leaves the track system.

When the operator enters the train and the car numbers from the console, he enters the train number and a car number for each car, and that information goes into permanent storage, such that every car within a particular train is known. The tracking subsystem 110 tracks by train number, and when an operational problem occurs the tracking subsystem 110 searches the original table to establish the train number and the vehicle cars involved with that problem. The interlocking subsystem 114 furnishes direction information for about ⅔ of the track circuits. The interlocking subsystem 114 requires this direction information in order to allow a train to move safely. As soon as the train move is made, the direction information disappears because the interlocking subsystem 114 does not need this information anymore. The tracking subsystem 110 must keep the direction information because when a block becomes unoccupied, the tracking subsystem 110 needs to know what direction the train is going, and this need could be seconds or even minutes after the interlocking direction information has disappeared. For example, an indication is sensed by the tracking subsystem 110 when a particular track circuit becoming occupied, such as track circuit 3. The direction table is constructed before the operation of the tracking program, and is constructed in relation to each track circuit to include the following information: the direction bit indication is east, the direction bit indication is west, a gate is cleared in the east direction or a gate is cleared in the west direction. Assuming that the direction table is so constructed for track circuit 3, when the tracking subsystem 110 senses track circuit 3 becomes occupied, it checks the direction table to see which direction the train is going. If it is west, the track circuit to the east, track circuit 4, is checked to see if a train was previously there, and if not, there is a false occupancy. If track circuit 4 is occupied, the train number in track circuit 4 is stored in the table for track circuit 3, The same train is now in both track circuits 3 and 4. In this example, the train moved into track circuit 3, which became occupied as soon as the train noses over into the track circuit 3 block. The direction of travel is known, so therefore the tracking subsystem 110 knows where the train came from. It looks back to the previous track circuit 4 to see if that track circuit is occupied, when the train crosses the boundary and two blocks have to be occupied. The tracking subsystem 110 knows that track circuit 3 is occupied by a particular train X. The next thing that is going to happen in the sequence for a moving train is track circuit 2 is going to become occupied, so now the tracking subsystem 110 looks back in the direction the train is coming from, track circuit 3, and there is a train there. The tracking subsystem 110 moves train X into block 2, so train X is now in blocks 3 and 2.

The next logical thing that happens is track circuit 3 will become unoccupied, and when it becomes unoccupied, the tracking subsystem 110 looks ahead in the direction the train is going, and if there is a train in track circuit 2, this is a proper operation so the train number is cancelled out of 3. If there is no train in track circuit 2, a dropout has occurred because the train which was supposed to be going into next block, did not. This dropout is alarmed. The tracking subsystem 110 follows each train one block at a time, all the way around the track system. All decisions are based on these things: the track circuit became occupied, the direction the train is moving and the track circuit became unoccupied. If there is a switch in the track circuit block, it adds another information check than has to be made.

Figure 4:
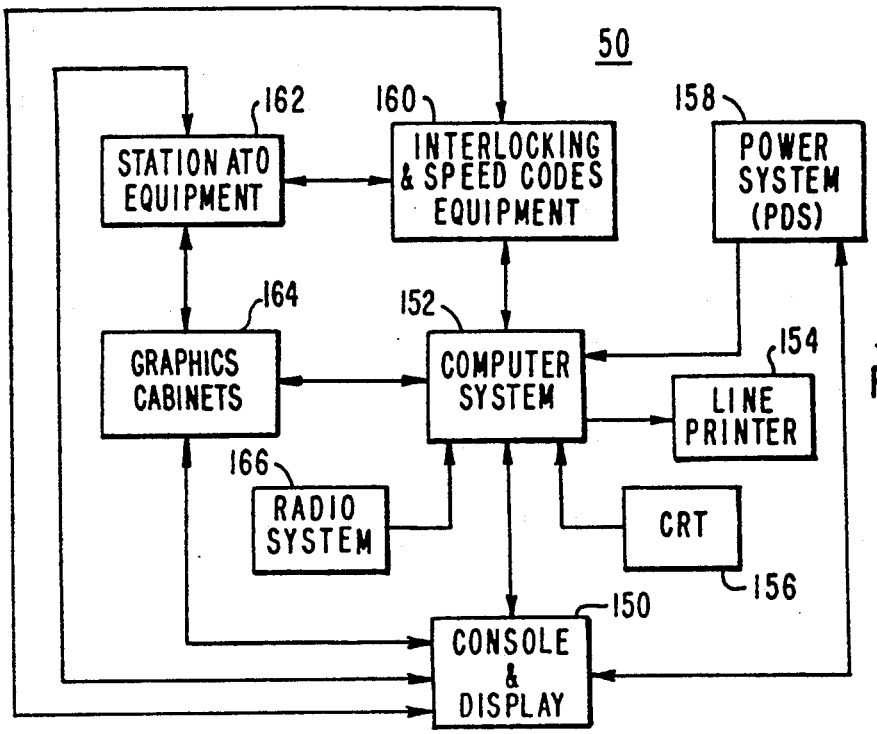
PRIOR ART FIG. 4
FIG. 4 shows a prior art central vehicle train control system block diagram.

FIG. 4 shows a prior art block diagram of the central control system 50 shown in FIG. 2. A console and display 150 is included and the operator inputs go into this console, with the status of the train system being shown on the display portion. The computer system 152 includes memory, input and output devices and the power supply. The line printer 154 is used to print the reports and the CRT display 156 is used to log all alarms as they occur. The power system 158 controls the actual track power to the entire system, and includes relays for the inputs that go into the computer system 152 and also go to the console and display 150. The control of the power system 158 does not go through the computer, but is hard wired directly to the console and display, with the status of the system going through the computer to allow the printout. The interlocking and speed control equipment 160 is well known and has been provided in many train control systems to establish where each train is going, when it is going and how fast it is going to go. The station ATO equipment 162 includes the non-vital relays associated with some of the train control and part of the graphics. The graphics 164 controls the graphics for signs at each of the stations on the system. The radio system 166 receives and transmits messages both data and voice to and from each of the cars on the system.

Figure 5:
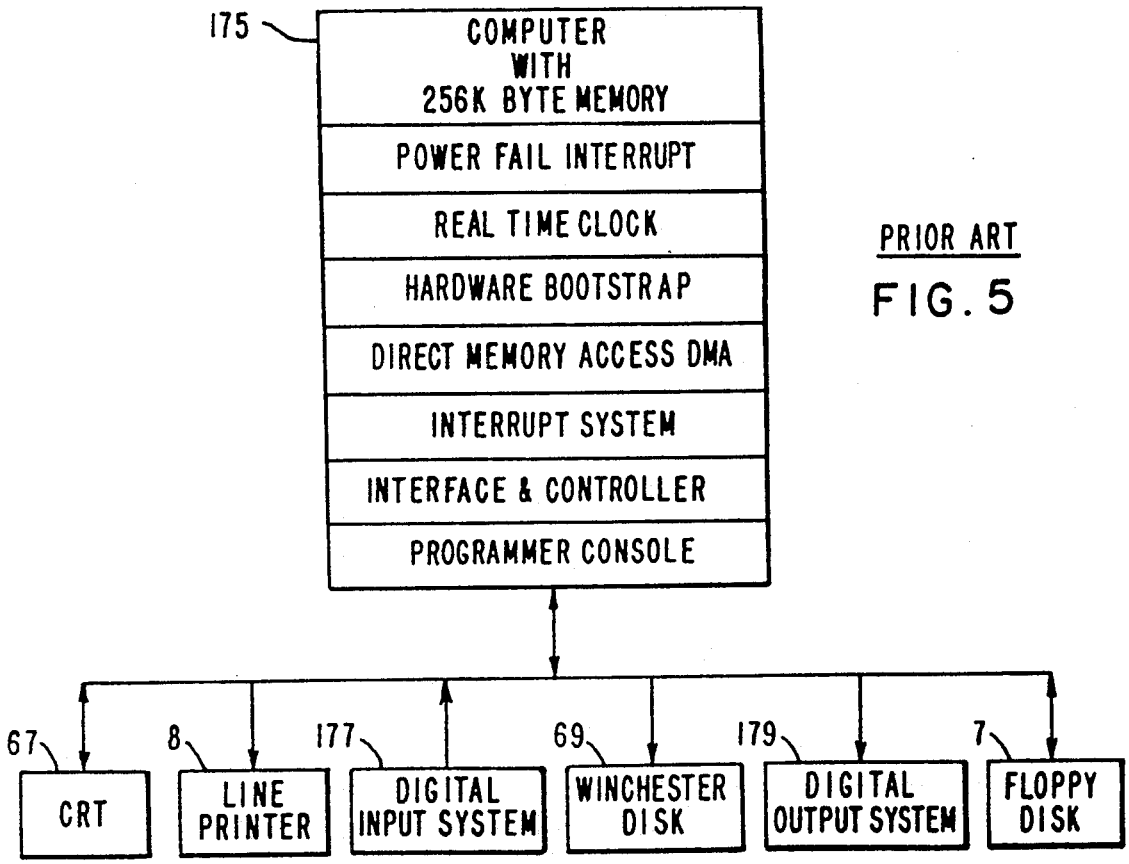
PRIOR ART FIG. 5
FIG. 5 shows a prior art control computer system for controlling vehicle trains.

In FIG. 5 there is shown a prior art computer system 152 suitable for use with the present invention. A standard digital computer 175 can be purchased for this purpose in the open market. The selected options include a power fail interrupt that senses when the power drops below some certain level and provides orderly shutdown, a real time clock, a hardware bootstrap loader in case it is desired to load a new program .manually, a direct memory access channel to allow high speed data transfer, an interrupt system and various interfaces and ,controllers. The provided peripherals include a CRT display 67 which is the real time logger, a Winchester disk, a floppy disc and a line printer. The digital input and digital output systems convey information to and from the rest of the control system.

Figure 6:
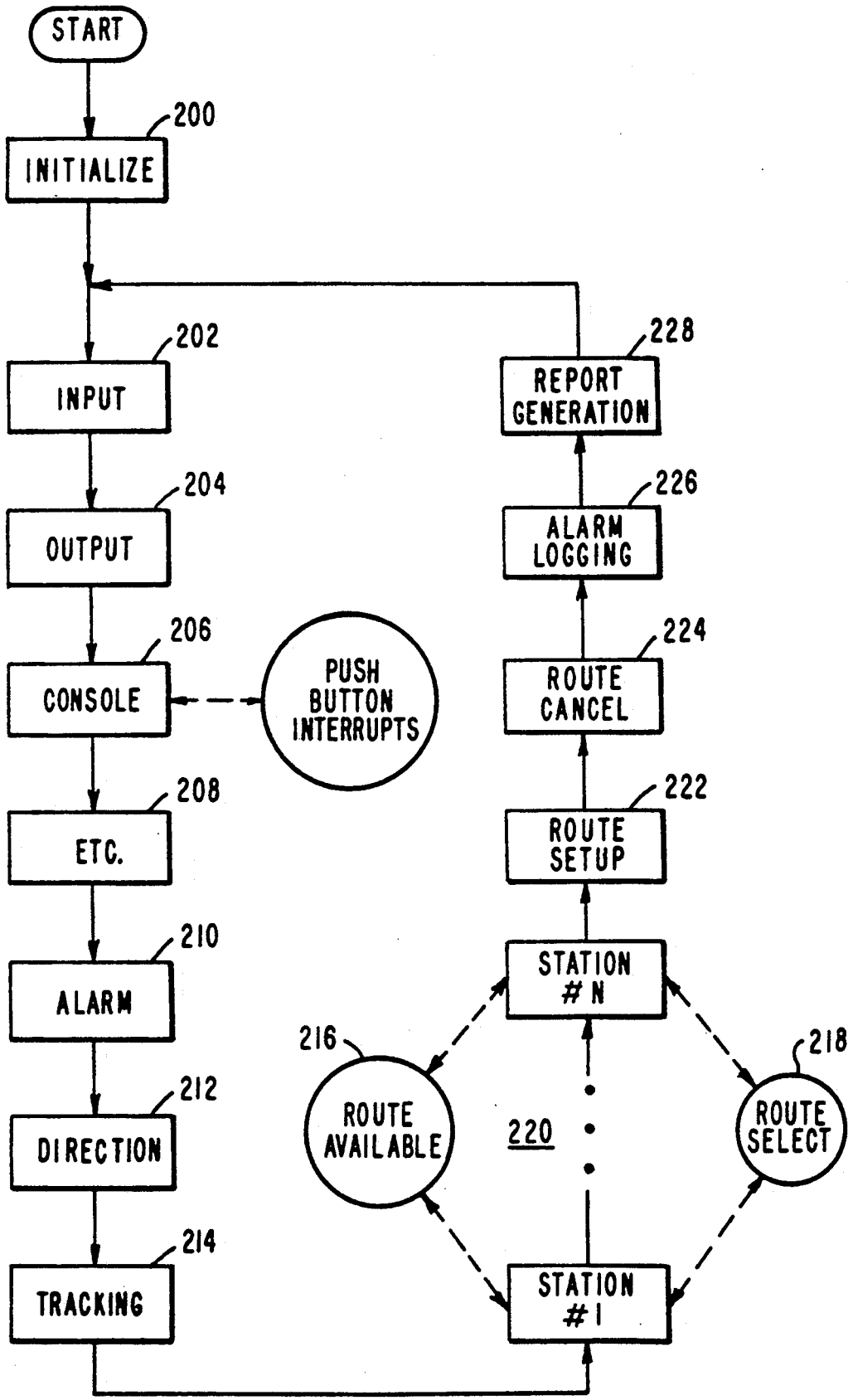
PRIOR ART FIG. 6
FIG. 6 shows a prior art control system sequential loop operations for controlling vehicle trains.

FIG. 6 shows a representation of the prior art tracking program control program as disclosed in above-referenced U.S. Pat. No. 4,361,301, to show the sequence of the different sections of the programming. The tracking program in general uses a plurality of different routines which are all per se prior state of the art logic. The first block 200 is initialization, which operates when power is lost or starting over for any other reason, such as a console pushbutton request. Block 200 clears away all traces of the past; any history of the trains being in any of the track circuits, status of switches and the like is just erased, and the program starts over. The input routine 202 inputs the signals from operator pushbuttons, switch positions, and so forth, to provide every desired input from the outside world, which are input once each program cycle so that every routine inside the program is working on the same information. The output routine 204 is used to provide every desired output each program cycle. The console routine 206 is a well-known routine to process the information from the operator to the computer, and vice versa; it handles all the pushbuttons, all thumbwheel switches, the digital displays, and so forth, and stores in memory whatever information is required for other sections of the program. The ETC routine 208 takes the track circuit inputs that were input by a previous routine and compares the values against previous values for the same track circuits respectively to see if any changes have occurred to build up a series of tables, a past value table, a change table, a went-to-one table, and a went-to-zero table. The routine 208 takes the input and exclusive ORS that value with the past value for the same track circuit to determine a change of state. There is a need to know which direction that change of state was, so ANDing each change of state with the present value, establishes that it went to one which means the track circuit just became occupied, and is stored in the went-to-one table. There is a need to know when the bits disappear so the routine 208 AND's the changes with the past values, and this results in the bits which just went to zero. The table handling routines in the ETC routine 208 do the same thing for track circuits, switch positions, gate indications, and pushbuttons. The alarm routine 210 uses information from the tracking program. For example, if a train is late getting to a station, the program needs to know which train it was, and that information is provided by the tracking program. The alarm program 210 provides an alarm when switches do not move in time, gates do not clear in time, doors do not open in time, trains do not leave the station on time, trains do not get to a station on time, and when trains run through a station. The tracking program comprises the direction routine 212 and the tracking routine 214. The next 16 blocks on this flowchart are the station and pseudo station programs 220, which includes a route available subroutine 216 and a route select subroutine 218. A pseudo station is a place where a train stops; does everything it would in a regular station, except open its doors. The program does not know the difference.

The routing disclosure covered by the above cross-referenced U.S. Pat. No. 4,361,300 is primarily associated with the stations logic programs, where all the routing is initiated. Each of the station programs 220 checks to see if there is a route available and to select that route if it is available. Each of the stations in the routing disclosure has three separate programs; one of them is the station entry logic where all processing necessary to get a train into a station is covered. It is complete when a train runs through the station or when the train doors open. The second set of programs associated with the station is the in-station logic, which involves the route selection and is completed when the route to the next station is selected. The last set of stations programs is for station exit logic, where everything is done to check the train out of a station after the dwell time and the headway time have elapsed, such as closing the doors and sending information to the next station ahead that the train is coming, sending information that the train has started, and sending the train number. The train number is derived from the tracking program. At the time the station routine is complete, any route that is required and is requested is stored in memory. Following the station program 220 is the route setup routine 222 which is a software interlocking request program, which requests that all of the routes selected in the previous 16 station programs 220 be set up by interlocking. It does this by requesting switch positions, monitoring the switch indications until all switches are in position, and then requesting gates and locking out all opposing routes. The route setup routine 222 is explained in more detail in the above-referenced U.S. Pat. No. 4,361,300.

Next is the route cancel routine 224, which cancels a route. When a train takes the route, the route is then cancelled, track circuit by track circuit, as the train goes through, to provide a more or less equivalent operation to the well-known sectional release in the prior art hardware interlocking apparatus. The alarm logging 226 and report generation 228 provide the logging in memory of any alarm condition or operator action. This information is stored until a report is generated once a day such as at midnight. Alarms are generated by the false occupancies and the dropouts which are detected by the tracking program. The program shown in FIG. 6 then goes back and performs another repeat of the illustrated subroutines and continuously goes around the cycle.

Figure 7:
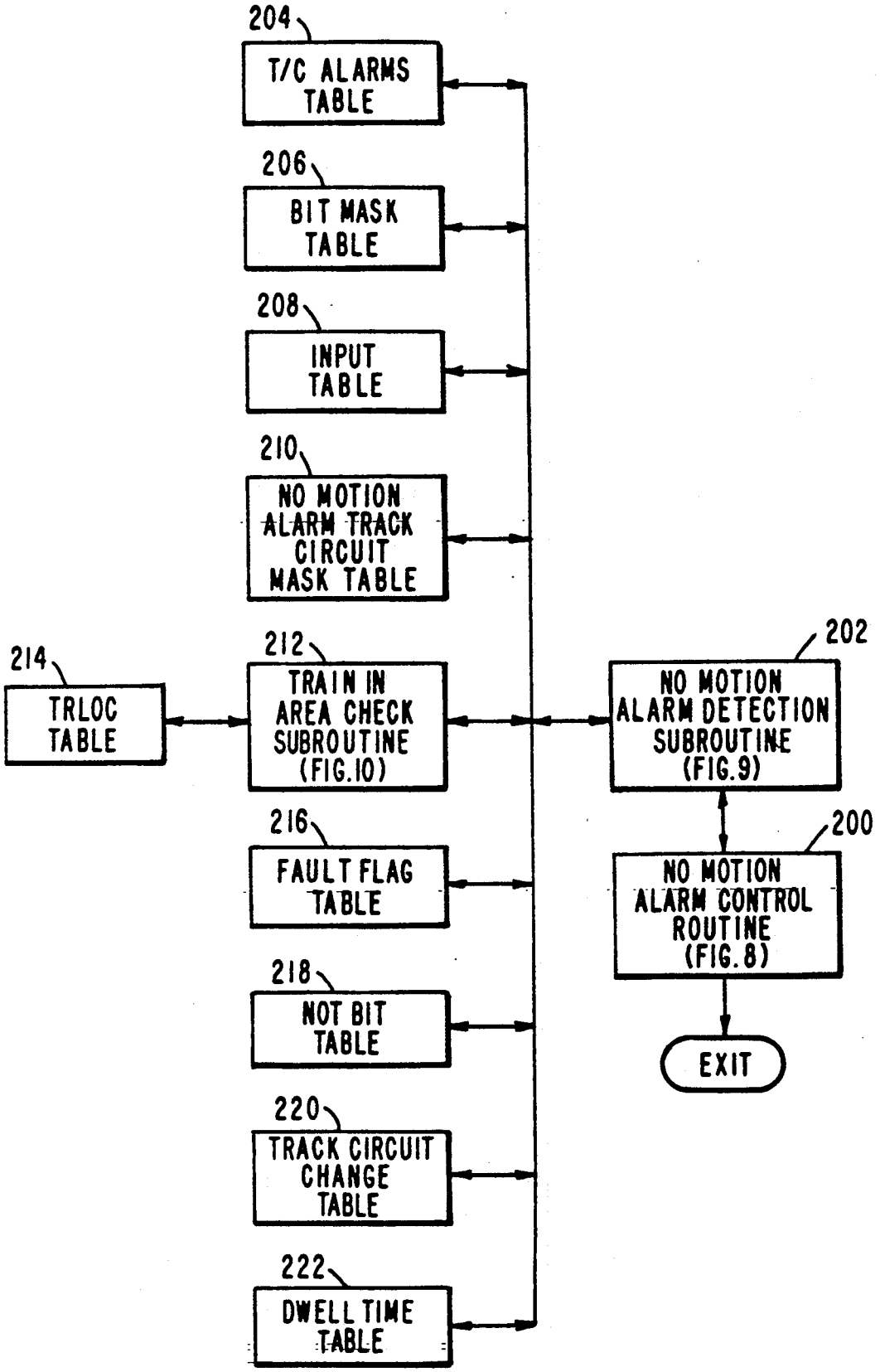
FIG. 7 shows a functional block diagram of the present invention.
Figure 8:
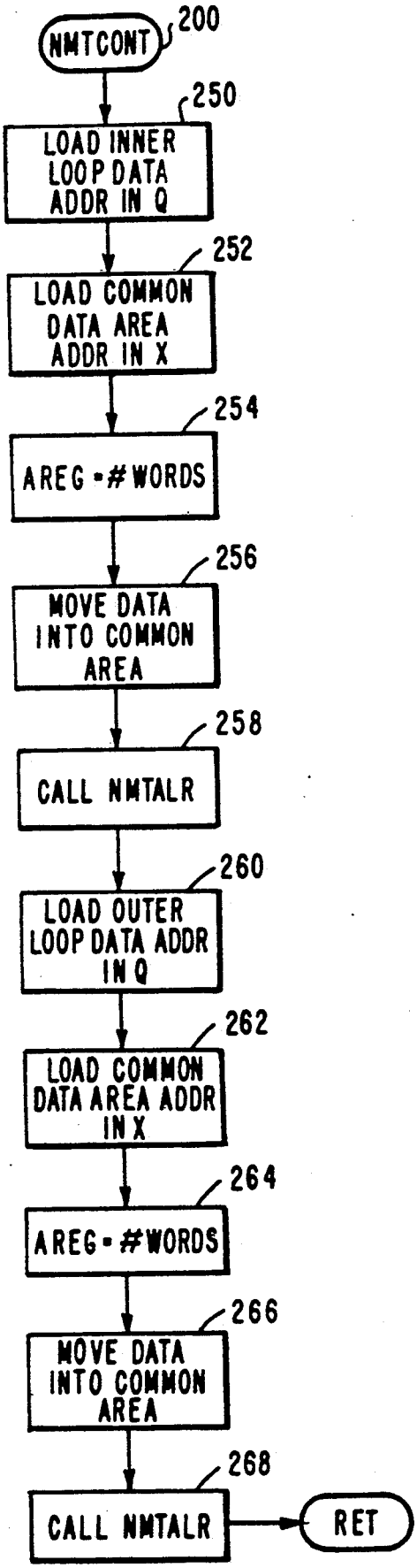
FIG. 8 shows the no motion alarm control routine shown in FIG. 7.
Figure 10:
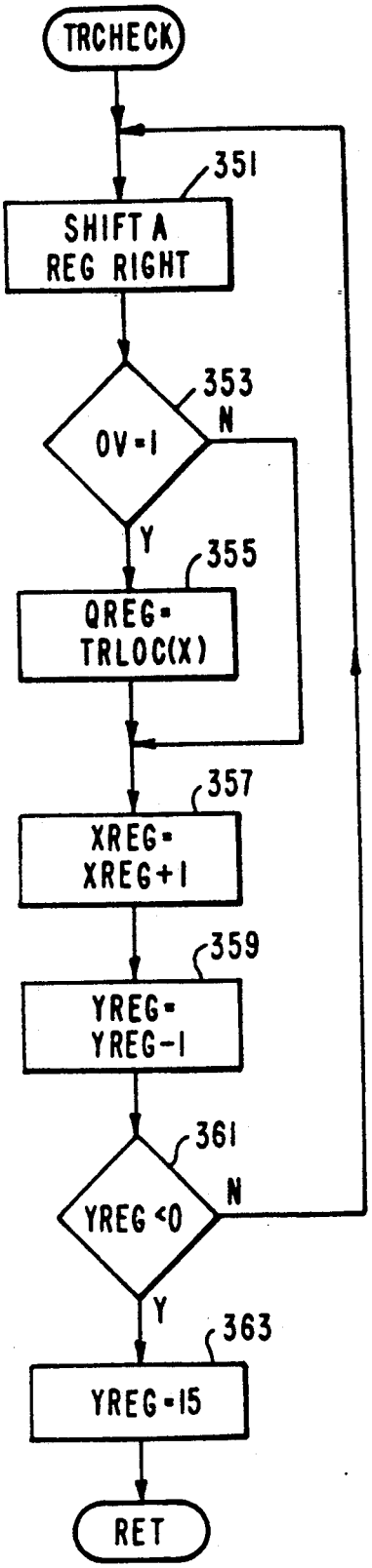
FIG. 10 shows the train in area check subroutine shown in FIG. 7.
Figure 9A:
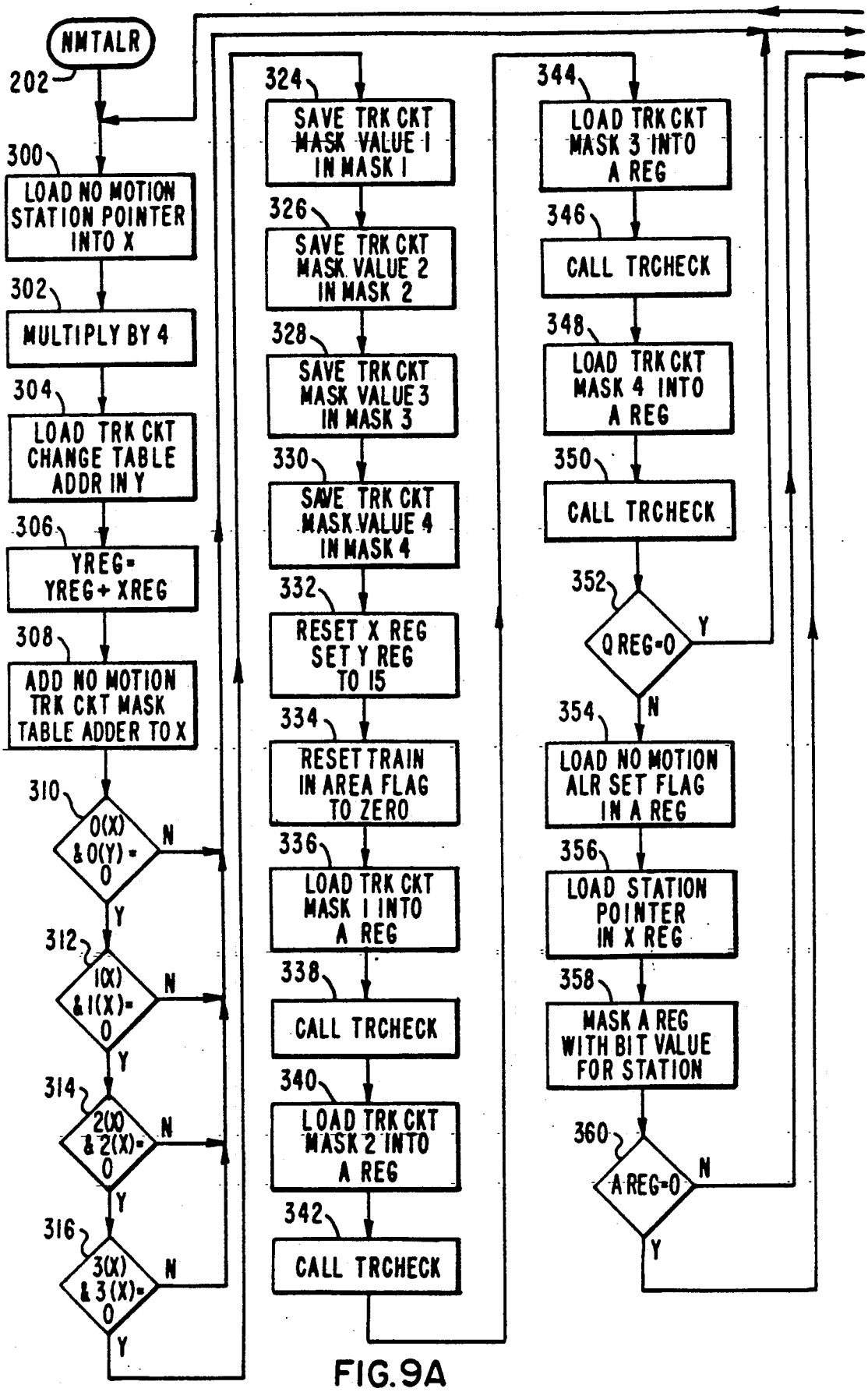
FIG. 9 shows the no motion alarm detection subroutine shown in FIG. 7.
Figure 9B:
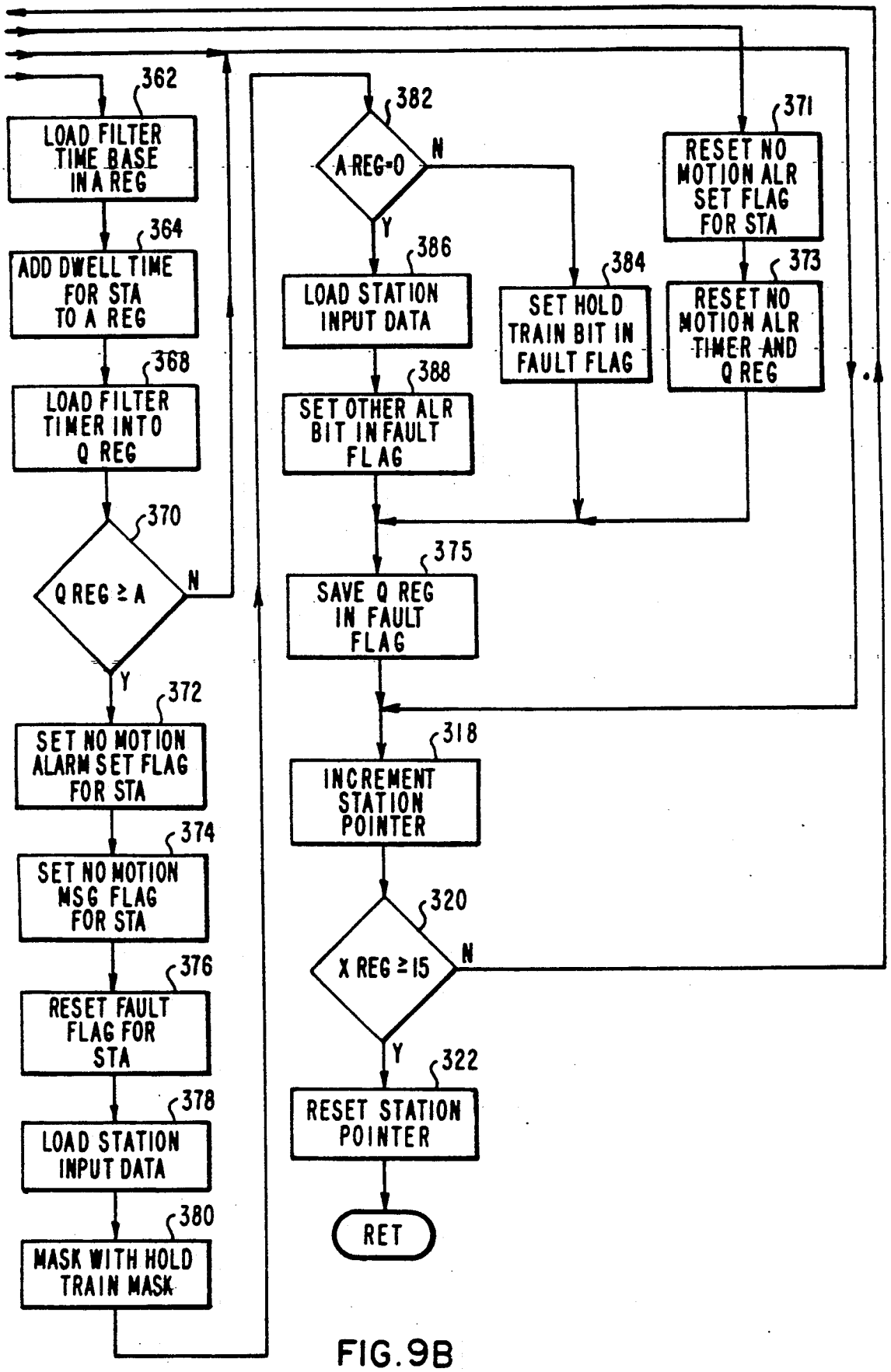

In FIG. 7 there is shown a functional block diagram of the present invention to illustrate the no motion alarm control program 200, which is shown in FIG. 8, in relation to the no motion alarm detection subroutine 202, which is shown in FIG. 9. These programs operate with a track circuit alarm table 204, a bit mask table 206 that includes individual bits used to mask out the desired track circuit information, an input table 208 containing the input image used by all routines, a no motion alarm track circuit mask table 210 including 8 words having 16 track circuits in each word such that particular bits used with the track circuit input table relate to a designated section of track to be checked between the respective stations, a train in area check subroutine 212, which is shown in FIG. 10, to determine if there is a train in the area of interest. A track location table 214 that contains the train number of a train in any track circuit that is occupied and when a fault is established this table permits printing out the train number. The fault flag table 216 shows a fault where there is no motion when a train is in a given area, and once a fault is found, the flag is set and a timer is started. The not bit table 218 is the complement of the bit table. The track circuit change table 220 is operative with the tracking routine described in U.S. Pat. No, 4,361,301 to show all track circuits where there was motion during the last program cycle. The dwell time table 222 shows the provided train dwells in every station and that can be in the order of 15 seconds. The fault timer has to be in addition to this scheduled dwell time.

In FIG. 8 there is shown a flow chart of the no motion alarm control routine 200 shown in FIG. 7. This is a bookkeeping routine that operates to gather information from the train tracking program 214 and from the input program 202, and moves this information into a common area. The data is then moved through a shift register to see if there is a bit set to zero to indicate the presence of a train in a particular track circuit in either the inner loop 14 or in the outer loop 12 of track. At block 250 the inner loop data address is loaded into register Q, which would be data relating to the track circuits of inner loop 14 as shown in FIG. 1. At block 252 the common data area address is loaded into register X. At block 254 the A register is loaded with the number of words to be moved. At block 256 this data is moved into the common area. At block 258 the no motion alarm detection subroutine shown in FIG. 9 is called. At block 260 the outer loop data address is loaded into register Q, which would be data relating to the track circuits of outer loop 12 as shown in FIG. 1. At block 262 the common data area address is loaded into register X. At block 264 the A register is loaded with the number of words to be moved. At block 266 this data is moved into the common area. At block 268 the no motion alarm detection subroutine shown in FIG. 9 is called. The program shown in FIG. 8 then returns to the no motion alarm central routine 200 shown in FIG. 7.

There are a known number of stations in the track to be checked. For example as shown in FIG. 1, there are nine stations in each of the outer loop 12 and the inner loop 14. For a 16 bit microprocessor, a 16 bit word is appropriate to check those 9 stations and provide some room for future expansion of the track system. Since the track circuits are not positioned in a clear order, but rather track circuits in the inner loop are numbered in the 100s, those in the outer loop are numbered in the 200s and those in the maintenance area are numbered in the 500s, it was decided to provide four mask words to branch and cover the entire track system shown in FIG. 1. With 9 stations and four mask words per station, this requires 36 words in the mask table. The track circuit change table TRLOC from the tracking program indicates where the trains are located.

In FIG. 9, the no motion alarm detection subroutine 202 is shown. At block 300 the no motion station pointer is loaded into register X. At block 302, the contents of the register X is multiplied by four. At block 304, the track circuit change table address is loaded into register Y. At block 306, the two register numbers are added together. At block 308 the no motion mask table is added into the X register. Thusly, the two index registers are now set to enable comparing one table against the other table. At block 310, the first word in the X table is compared with the first word in the Y table. At block 312 the second word of one table is compared with the second word of the other. At block 314, the respective third words of the X and Y tables are compared. At block 316, the respective fourth words are compared. If there is a no for any of these comparisons between the track circuit change table and the mask table, this indicates there is motion since the comparison was not zero and this is not of interest to the no motion alarm detection purpose of this program, so the program goes to block 371 where the no motion alarm set flag for a station is reset. At block 373 the no motion alarm timer and Q register are reset, and at block 375 where the Q register is saved in the fault flag. Block 318 increments the station pointer. At block 320 a check is made to see if the X register is now greater than or equal to 15, and if so, at block 322 the station pointer is reset. If the comparisons at blocks 310, 312, 314 or 316 are zero, then at respective blocks 324, 326, 328 and 330 the mask value is saved that fits the track circuit mask value change in the corresponding register location mask 1, mask 2, mask 3 or mask 4 since they are stored through the index register. At block 332 the X register is reset and the Y register is set to 15 because these are 16 bit words that will be shifted and checked for no motion of the vehicle trains known to be in particular track circuits. At block 334, the train in area flag is reset to zero. At block 336 the track circuit mask 1 is loaded into the A register for checking, since there is a nonzero bit in one of these four words and it is desired to identify the track circuit where a vehicle train is located without motion. At block 338, the train in area check subroutine shown in FIG. 10 is called to see if there is actually a train in the track circuit indicated by the zero bit in the corresponding mask word being checked. This same operation is provided at blocks 340 and 342 for the word mask 2, at blocks 344 and 346 for the word mask 3 and at blocks 348 and 350 for the word mask 4.

In the train in area check subroutine, shown in FIG. 10, at block 351 the word being checked is shifted to the right one bit and checks to see if this provides an overflow at block 353. If yes, at block 355 the train number is loaded from the train location table into the Q register. At block 357 the X register is incremented by one to increase the track circuit counter. At block 359 the X register is decremented by one to count the number of bits in a word. At block 361 a check is made to see if this word is finished, which happens when the count is less than zero. At block 363 the Y register is set to 15 to prepare for the full count on the next series of words and a return is made to the no motion alarm detection subroutine. This operation provides the number of the vehicle train that is not moving and is normally supposed to be moving.

At block 352 of FIG. 9 a check is made to see if the Q register is zero, which would happen if there was no train located in any of the track circuits checked by the train in area check subroutine. If yes, the program goes to block 371 where the no motion alarm set flag for a station is reset, and through block 373 where the no motion alarm timer and Q register are reset, block 375 where the Q register in fault flag is saved, and through reset blocks 318, 320 and 322. If the Q register is not zero at block 352, then at block 354 the no motion alarm set flag is loaded into the A register. At block 356 the station pointer is loaded into the X register to find out what station is involved. At block 358 the A register is masked with the station word. At block 360 a check is made to see if the A register is zero, and if not the program resets at blocks 318, 320 and 322. If it is zero, at block 362 the timing operation starts by loading the filter time base in register A. At block 364, the station dwell time is added to the A register. At block 368 the filter time is loaded into the Q register. In block 370 the station dwell time plus the filter time base is compared with the clock time to see if an alarm condition is found, and if not the routine goes to block 318 and the exit. If yes, the delay time exceeds the clock time, and at block 372 the no motion alarm set flag for the station is set. At block 374 the no motion message flag for the station is set. At block 376 the fault flag for the station is reset because once it is printed the flag is reset for the next time through the program. In an effort to determine what the operator is doing, at block 378 the station input data is loaded. At block 380, a mask for the hold train function is provided. At block 382 a check is made to see if this was the reason for the alarm, and if the A register is not zero, then at block 384 the hold train bit in the fault flag is set and at block 375 the fault is saved in the fault flag table. If the A register is zero in block 382, then at block 386 the station input data is loaded, and at block 388 the other alarm bit is set in the fault flag.

If desired, the vehicle doors could be checked in this same manner, with a sinular sequence of the four blocks 378, 380, 382 and 384.

When a train is stopped with a problem, after block 388 the program goes to block 375 to save the fault in the fault flag table, and at block 320 a check is made to see if all of up to 15 stations have been checked. With the example of 10 such stations being provided in FIG. 1, after all 10 of these stations have been checked in this manner, the station pointer is reset to zero at block 322, and the routine exists.

The program operates to check the movement of each train in relation to each track signal block that the train tracking program indicates is occupied by determining every change of status in any occupied track circuit. If none of the track circuits becomes either unoccupied or occupied within thirty seconds, this indicates there might be a no motion problem. Two sets of checks are provided, one check is made between stations and one check is made in the stations. When a problem is found, this program goes to the train tracking program tables to get the train number out. The station area that has a problem is detected in relation to the no motion train that is in the station. The first check determines if there is a train in a given track circuit, and if there is none, then there is no problem in relation to that track circuit. If there is a train in a given track circuit, then a check is made to see if the timer has expired. If the answer is no, there is no problem but do not reset the timer because there is a train there. After the timer expires, the alarm is set and then an effort is made to find out what caused it.

We claim:

1. A monitoring system for detecting when any of one or more trains operating in a transit system is not moving along the system track as desired, the system track being divided into successive track signal blocks each having means for generating a signal indicating whether a train is occupying any portion of the signal block, said monitoring system comprising:
   - computer means for storing the respective occupancy signals for the track blocks;
   - said computer means periodically comparing new and past occupancy signal values for the track blocks to indicate occupancy changes;
   - means for resetting an alarm timer for each block occupancy change;
   - means for enabling each running timer to continue operation if no occupancy change has occurred in the block to which the timer corresponds; and
   - means for generating a system operator alarm when any running timer reaches a present time limit to indicate a no-motion train condition requiring system level supervisory action.

2. A monitoring system as set forth in claim 1 wherein means are provided for detecting whether any of one or more predetermined train operator overrides apply to a detected no-motion train condition and for negating the generation of a system alarm for any no-motion train condition for which such an override exists.

3. A monitoring system as set forth in claim 2 wherein the operator overrides include an operator hold.

* * * * *